US007303423B2

(12) United States Patent
Hayashi et al.

(10) Patent No.: US 7,303,423 B2
(45) Date of Patent: Dec. 4, 2007

(54) SQUIB-TYPE ELECTRICAL CONNECTOR WITH MULTIPLE ENGAGEMENT MEANS

(75) Inventors: Toshiaki Hayashi, Aichi (JP); Atsushi Nishida, Aichi (JP); Masato Minakata, Aichi (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/370,969

(22) Filed: Mar. 8, 2006

(65) Prior Publication Data

US 2006/0205268 A1 Sep. 14, 2006

(30) Foreign Application Priority Data

Mar. 8, 2005 (JP) ..... 2005-063920

(51) Int. Cl.
*H01R 13/62* (2006.01)

(52) U.S. Cl. ..... 439/367

(58) Field of Classification Search ..... 439/367, 439/352, 923, 350

See application file for complete search history.

(56) References Cited

U.S. PATENT DOCUMENTS 4,758,183 A * 7/1988 Aoyama ..... 439/596
5,718,596 A * 2/1998 Inaba et al. ..... 439/352
5,769,650 A * 6/1998 Aoyama et al. ..... 439/189
6,203,342 B1 3/2001 Gauker
6,383,021 B1 * 5/2002 Murakami et al. ..... 439/587
6,475,014 B2 * 11/2002 Tsuji et al. ..... 439/352
6,848,931 B2 * 2/2005 McMullen et al. ..... 439/350

FOREIGN PATENT DOCUMENTS

JP 2002-025707 1/2002

* cited by examiner

*Primary Examiner*—Chandrika Prasad
(74) *Attorney, Agent, or Firm*—Barley Snyder LLC

(57) ABSTRACT

An electrical connector includes a connector housing having a contact engaging section with contacts which engage mating contacts, and a wire holder holding wires connected to the contacts. The connector cover is capable of moving between partially engaged position and fully engaged position. The partially engaged position is the position in which a rear end of the wire holder is housed in and the fully engaged position is the position in which the rear end of the wire holder projects from a rear end opening. The connector housing has a first engaging section engaging a mating connector in the partially engaged position. The connector cover has a second engaging section engaging the first engaging section and restraining disengagement of the first engaging section from the mating connector in the fully engaged position.

5 Claims, 6 Drawing Sheets

SQUIB-TYPE ELECTRICAL CONNECTOR WITH MULTIPLE ENGAGEMENT MEANS

FIELD OF THE INVENTION

The present invention relates to an electrical connector allowing inspection of engagement of the connector with its mating connector.

BACKGROUND

In an automobile assembly line, workers have to repeat operations for securely engaging an electrical connector with its mating connector in a limited working space and time.

For example, Japanese Patent Application Publication No. 2002-25707 teaches various types of electrical connectors each provided with an inspection member to allow workers to easily inspect engagement of an electrical connector with its mating connector.

However, providing a specific inspection member has the disadvantage of making an electrical connector larger. For example, a squib connector for supplying power to an air bag needs to be smaller as an airbag is installed in confined space such as a steering section. Moreover, the recent trend toward smaller devices requires that electrical connectors constituting the devices should also be smaller.

SUMMARY

In view of the above circumstances, the present invention provides an electrical connector that achieves full engagement with its mating connector in a one-step action and allows visual inspection of the engagement without a specific inspection member.

An electrical connector of the present invention includes a connector housing having a contact engaging section formed in the front side thereof and provided with contacts adapted to engage mating contacts. A wire holder is formed in the rear side of the housing which holds wires which are connected to the contacts and extend toward the rear side. A connector cover having a front end opening and a rear end opening is capable of moving between a partially engaged position and a fully engaged position. In the partially engaged position, a rear end of the wire holder is housed in the connector cover and in the fully engaged position, the rear end of the wire holder projects from the rear end opening thereof. The connector housing has a first engaging section adapted to engage a mating connector fitted into the contact engaging section when the connector cover is in the partially engaged position. The connector cover has a second engaging section which engages the first engaging section when the connector cover is in the fully engaged position and restrains disengagement of the first engaging section from the mating connector.

The electrical connector of the present invention is configured such that the rear end of the wire holder projects from a cover rear end opening when the cover is in the fully engaged position, in which disengagement of the first engaging section of the housing from the mating connector is prevented. Accordingly, a worker can inspect engagement of the housing with its mating connector just by checking whether or not the rear end of the wire holder projects from the cover rear end opening. This dispenses with a specific inspection member, as the housing to be engaged with the mating connector combined with the cover also serves as an inspection member. Consequently, the electrical connector of the present invention achieves full engagement and easy inspection of the engagement by pushing the cover into the mating connector in a one-step action while maintaining minimization of the connector.

DETAILED DESCRIPTION OF THE PREFERRED EMBODIMENTS

An embodiment of the present invention will be described below with reference to the attached drawings.

Figure 1:
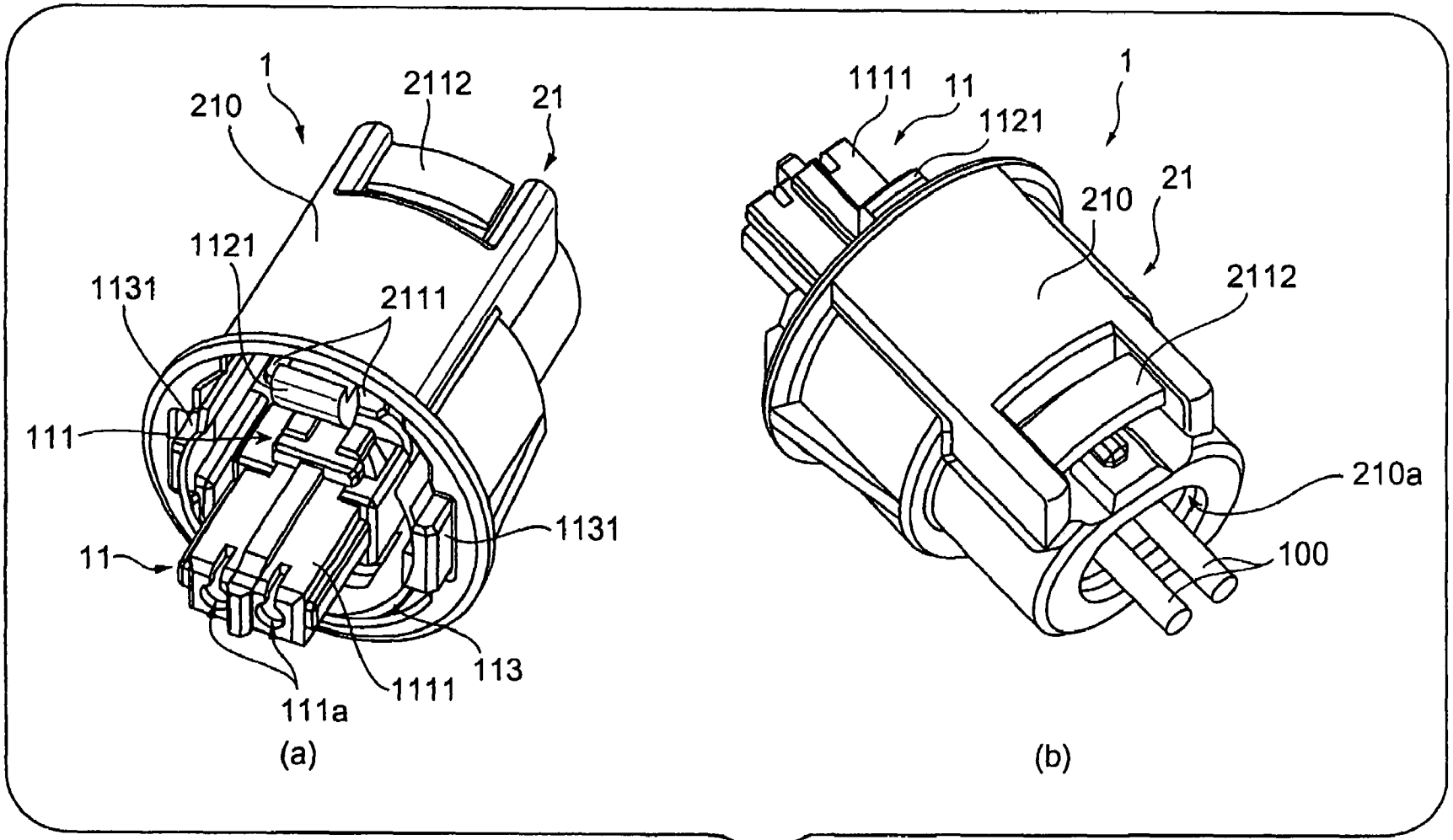
FIG. 1 is perspective views of an electrical connector according to an embodiment of the present invention.

Part (a) of FIG. 1 shows an external perspective view of an electrical connector 1 (hereafter referred to as "connector 1") viewed from its front according to an embodiment of the present invention and Part (b) of FIG. 1 shows another external perspective view of the connector 1 viewed from its rear.

Hereafter, the front side of the connector 1 shown in Part (a) of FIG. 1, which engages its mating connector 30, is designated as "front," while the rear side of the connector 1 shown in Part (b) of FIG. 1, which is opposite to the side of the connector 1 engaged with its mating connector 30 (see FIG. 4), is designated as "rear." The connector 1 of FIG. 1 is a squib connector for supplying power to an airbag of an automobile.

The connector 1 of FIG. 1 is provided with a connector housing, hereafter simply referred to as "housing 11", and a connector cover, hereafter simply referred to as "cover 21".

Figure 3:
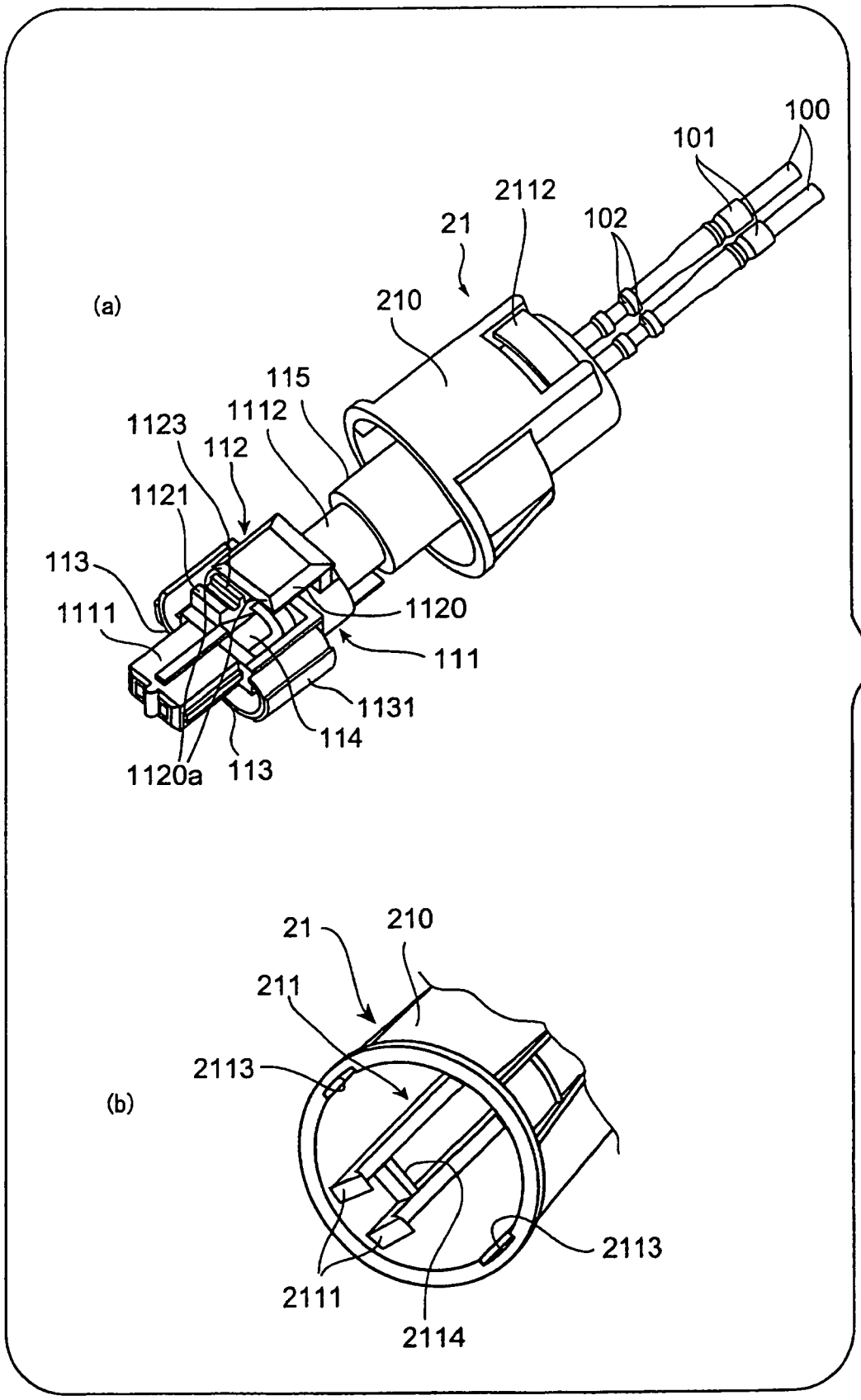
FIG. 3 is exploded views of the electrical connector shown in FIG. 1.

The housing 11 includes a contact engaging section 1111, a body 111, a connector locking arm 112 (see Part (a) of FIG. 3) and a guide section 113. The contact engaging section 1111 is provided with female contacts 102 (see Part (a) of FIG. 3) which engages male contacts 34 of a mating connector 30 (see FIG. 4). The body 111 includes a wire holder 1112 (see Part (a) of FIG. 3) for holding wires 100 which are connected to the female contacts 102 and extend toward the rear side. The connector locking arm 112, formed on the body 111 and extended toward the front side thereof, is resiliently movable. The guide section 113 surrounds the body 111 together with the connector locking arm 112.

The connector locking arm 112 has a locking section 1121 at the end thereof that engages an engaging projection 311 (see FIG. 4) provided in the mating connector 30. The locking section 1121 is an example of a first engaging section according to the present invention.

As shown in FIG. 1, contact receiving openings 111*a* are formed in the contact engaging section 1111 of the housing 11, which receive the male contacts 34 of the mating connector 30.

FIG. 1 also shows projections 1131 formed on the guide section 113 sandwiching the body 111, which are used to position the housing 11 inside the cover 21.

The cover 21 includes a cover body 210 and a housing locking arm 211 (see Part (b) of FIG. 3) capable of moving between a partially engaged position in which the rear end of the wire holder 1112 of the body 111 is housed in, and a fully engaged position in which the wire holder 1112 projects from the cover rear end opening 210*a*.

The housing locking arm 211 (see Part (b) of FIG. 3) is provided inside the cover body 210, which is adapted to position and extend in the direction corresponding to the connector locking arm 112 (see Part (a) of FIG. 3) when the connector locking arm 112 is housed in the cover 21.

The housing locking arm 211 includes a twin locking section 2111 (see Part (b) of FIG. 3) and an operating section 2112 (see Part (a) of FIG. 3). The twin locking section 2111, formed in the front end of the housing locking arm 211 corresponding to the locking section 1121 of the connector locking arm 112, and the operating section 2112, formed at the rear end opposite to the twin locking section 2111, are capable of elastically and alternately moving up and down in direction opposite each other like a seesaw. The twin locking section 2111 engages the connector locking arm 112 in such a way as to allow the cover 21 to move between the partially engaged position and the fully engaged position.

Part (a) of FIG. 1 shows the twin locking section 2111 formed at the front end of the housing locking arm 211 (also see Part (b) of FIG. 3).

Part (b) of FIG. 1 shows the operating section 2112 formed at the rear end of the housing locking arm 211 (see Part (b) of FIG. 3), which will be described later in detail. Part (b) of FIG. 1 also shows that the wires 100 extend out of the cover rear end opening 210*a*.

Figure 2:
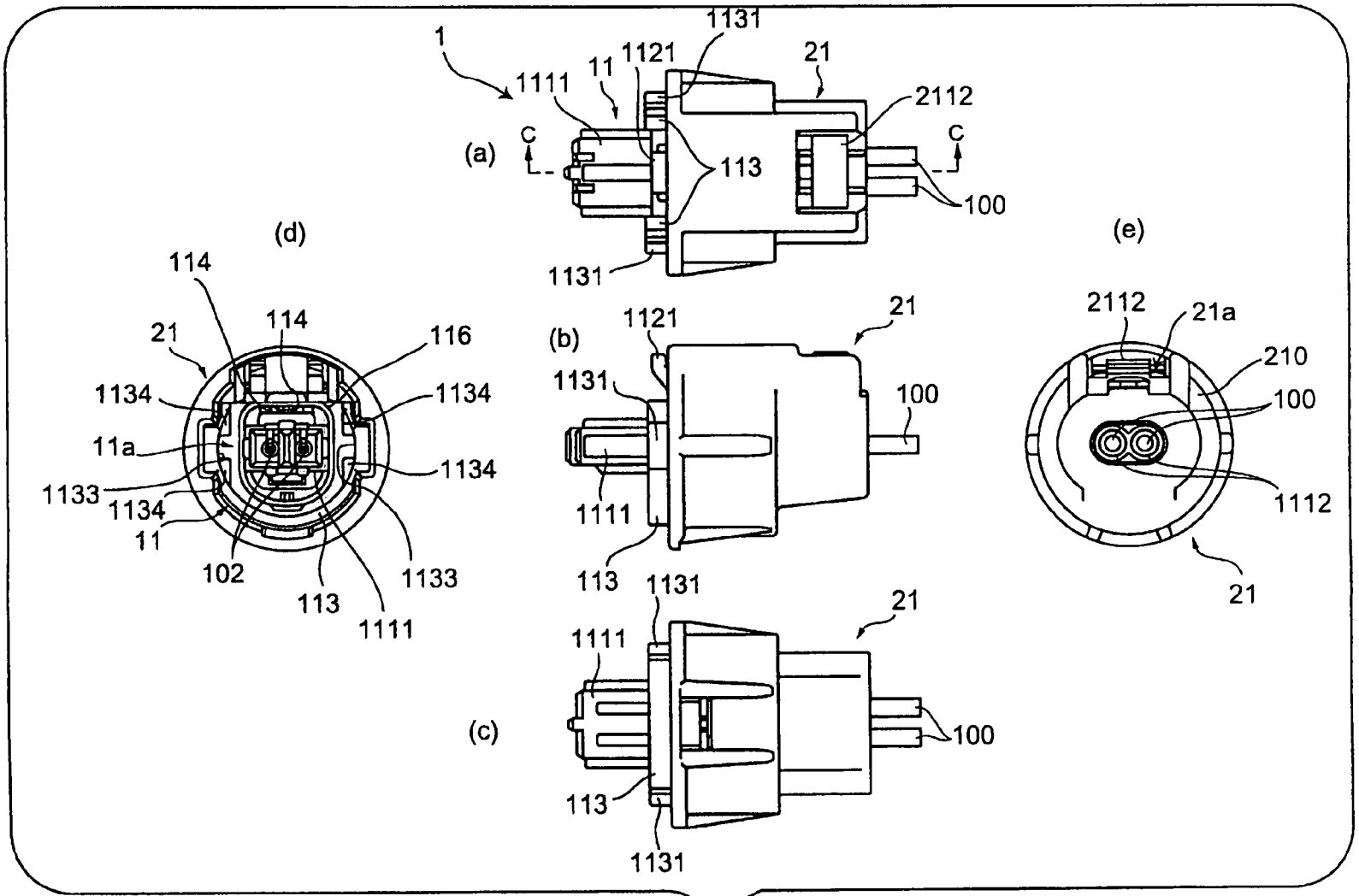
FIG. 2 includes a top view, a right side view, a bottom view, a front view and a rear view of the electrical connector shown in FIG. 1.

Parts (a) through (e) of FIG. 2 respectively show a top view, a right side view, a bottom view, a front view and a rear view of the connector 1 shown in FIG. 1.

FIG. 2 shows the connector 1 with the cover 21 attached thereto.

Parts (a) and (b) of FIG. 2 show that the locking section 1121 of the connector locking arm 112 is exposed from the front of the cover 21, while Part (d) of FIG. 2 shows that a seal ring 116 is provided in the position closer to the rear side of the body 111 than retainer 114 (also see Part (a) of FIG. 3) which retains the female contacts 102 inserted into the contact engaging section 1111 of the housing 11.

As shown in Part (e) of FIG. 2, space 21*a* is located between the operating section 2112 and the surface of the cover body 210, so that the operating section 2112 can be operated in the direction closer to the cover body 210. Part (c) of FIG. 2 shows the cover 21 viewed from the opposite side of Part (a) of FIG. 2.

FIG. 3 is the exploded view of the connector shown in FIG. 1.

Part (a) of FIG. 3 shows, from left, the contact engaging section 1111 at the front end of the body 111 of the housing 11, the guide section 113, the connector locking arm 112, the wire holder 1112 at the rear end of the contact engaging section 1111, ferrite member 115 for noise reduction, the cover 21 and the female contacts 102 pulled from the inside of the body 111 and connected to the wires 100 through a rubber stopper 101.

As shown in Part (a) of FIG. 3, the elastic connector locking arm 112 includes a base 1120, the locking section 1121 at front end thereof and projection 1123 between the base 1120 and the locking section 1121.

Part (b) of FIG. 3 shows the cover 21 viewed at such an angle as to reveal the housing locking arm 211. The housing locking arm 211 has legs (not shown) formed upright on the middle part between the front end and the rear end thereof, which are fixed to the inner wall of the cover body 210. The front end and the rear end of the housing locking arm 211 resiliently and alternately move up and down like a seesaw. More particularly, when the front end approaches the inner wall of the cover body 210, the rear end moves away from the inner wall and closer to the center of the cover body 210. Similarly, when the rear end approaches the inner wall of the cover body 210, the front end moves closer to the center of the cover body 210. Further, the housing locking arm 211 engages the base 1120 of the connecter locking arm 112 such that the cover 21 can move between the partially engaged position and the fully engaged position. The cover 21 is to be attached to the housing 11 as follows: at first, the operating section 2112 at the rear end of the housing locking arm 211 is pushed into the cover body 210 toward the center thereof, and then the twin locking section 2111 at the front end is lifted away from the center of the cover body 210; the projections 1131 of the guide section 113 are fitted into guide grooves 2113 formed on the inner wall of the cover body 210 of the cover 21; and finally the base 1120 of the connector locking arm 112 is inserted into the cover 21 until shoulder 1120*a* or the front end of the base 1120 goes under the twin locking section 2111.

In this way, the shoulder 1120*a* engages the twin locking section 2111, which prevents the housing 11 from projecting from the cover 21 toward the front side further than the position shown in FIG. 2.

Figure 4:
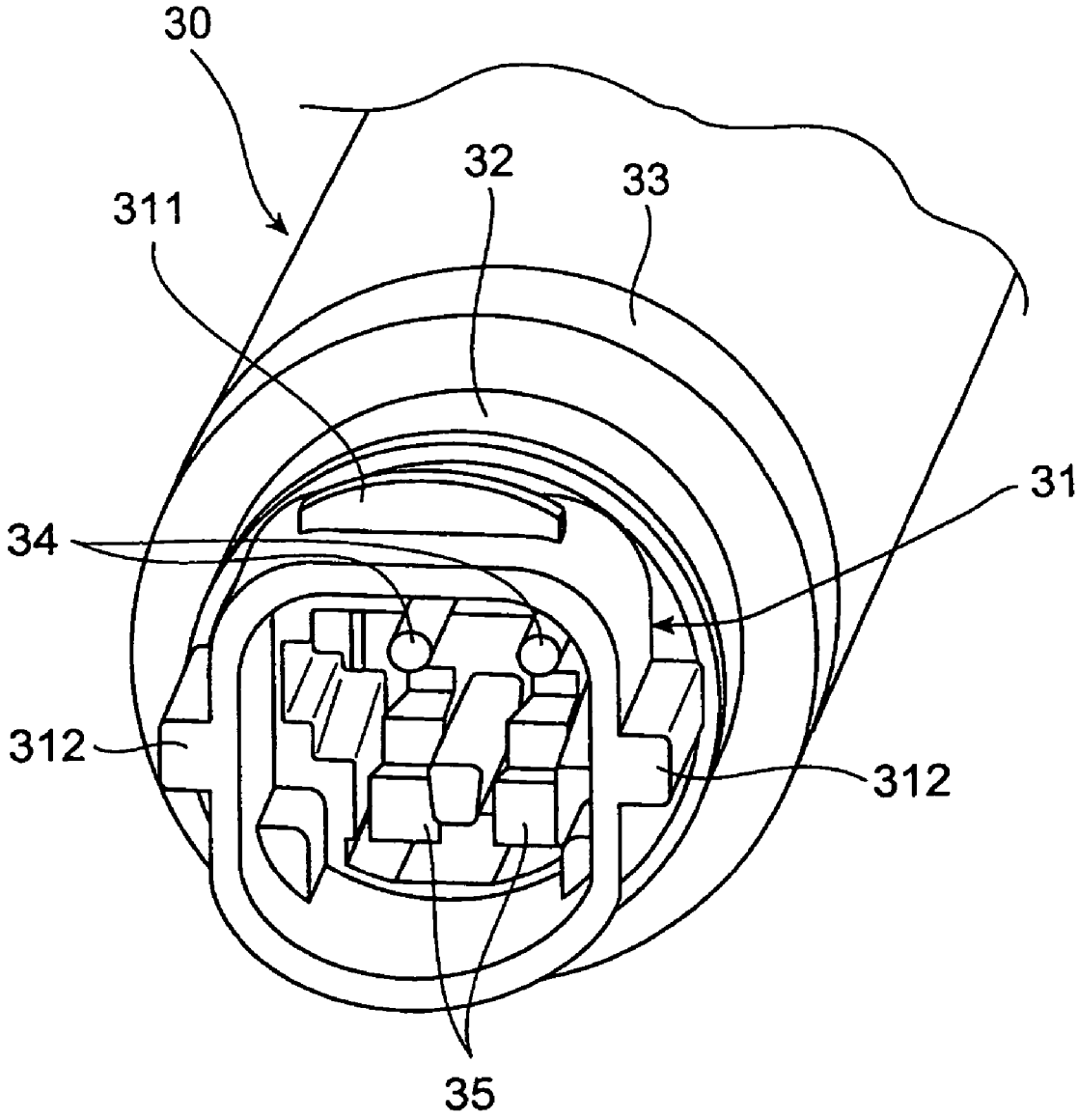
FIG. 4 is a perspective view of a mating connector.

FIG. 4 shows the external perspective view of the mating connector 30 to be engaged with the connector 1 of the present invention.

The mating connector 30 of FIG. 4 includes a mold section 31 at the front end, a holder 32 and a base 33. The holder 32 restrains further insertion of the male contacts 34 into the female contacts 102 of the housing 11.

The mold section 31 of the mating connector 30 is provided with the engaging projection 311, which engages the locking section 1121 of the connector locking arm 112 as well as the twin locking section 2111 of the housing locking arm 211. The mold section 31 is also provided with guide projections 312, which are fitted into guide grooves 1133 (see Part (d) of FIG. 2) formed on the guide section 113 of the housing 11. As shown in Part (d) of FIG. 2, each of the guide grooves 1133 is formed between two opposite walls 1134.

FIG. 4 also shows shorting clips 35, the ends of which contact the two male contacts 34 surrounded by the mold section 31. In case current is accidentally induced to the contacts, the clips 35 are intended to develop short circuits before engagement of connectors and thus prevent malfunction of a device connected to the contacts. This technique is already known and thus further explanation is omitted.

When the connector 1 engages the mating connector 30, the male contacts 34 of the mating connector 30 are inserted into the contact receiving openings 111*a* of the contact engaging section 1111 of the housing 11 (see FIG. 1) and the mold section 31 enclosing the male contacts 34 is inserted into space 11*a* shown in Part (d) of FIG. 2.

Now, referring back to FIG. 3, explanation will continue.

As shown in Part (b) of FIG. 3, a projection 2114, corresponding to the projection 1123 of the connector locking arm 112, is formed on the housing locking arm 211 in a position at the rear side of the twin locking section 2111. The projection 2114 is slightly tapered at its front. When the housing 11 engages the mating connector 30, the locking section 1121 of the connector locking arm 112 engages the engaging projection 311 of the mating connector 30. This is when the housing 11 is in the partially engaged position. By pushing the cover 21 further into the mating connector 30, the projection 2114 of the housing locking arm 211 goes beyond the projection 1123 of the connector locking arm 112 and the cover 21 moves to the fully engaged position. The projection 2114 is an example of a second engaging section according to the present invention. In order to move the housing 11 from the fully engaged position back to the partially engaged position, a worker needs to pull the cover 21 from the mating connector 30 while pushing the operating section 2112 into the cover 21 toward the center thereof. Once the housing 11 is moved back to the partially engaged position, a worker can disengage the locking section 1121 of the connector locking arm 112 and then the connector 1 from the mating connector 30.

Figure 5:
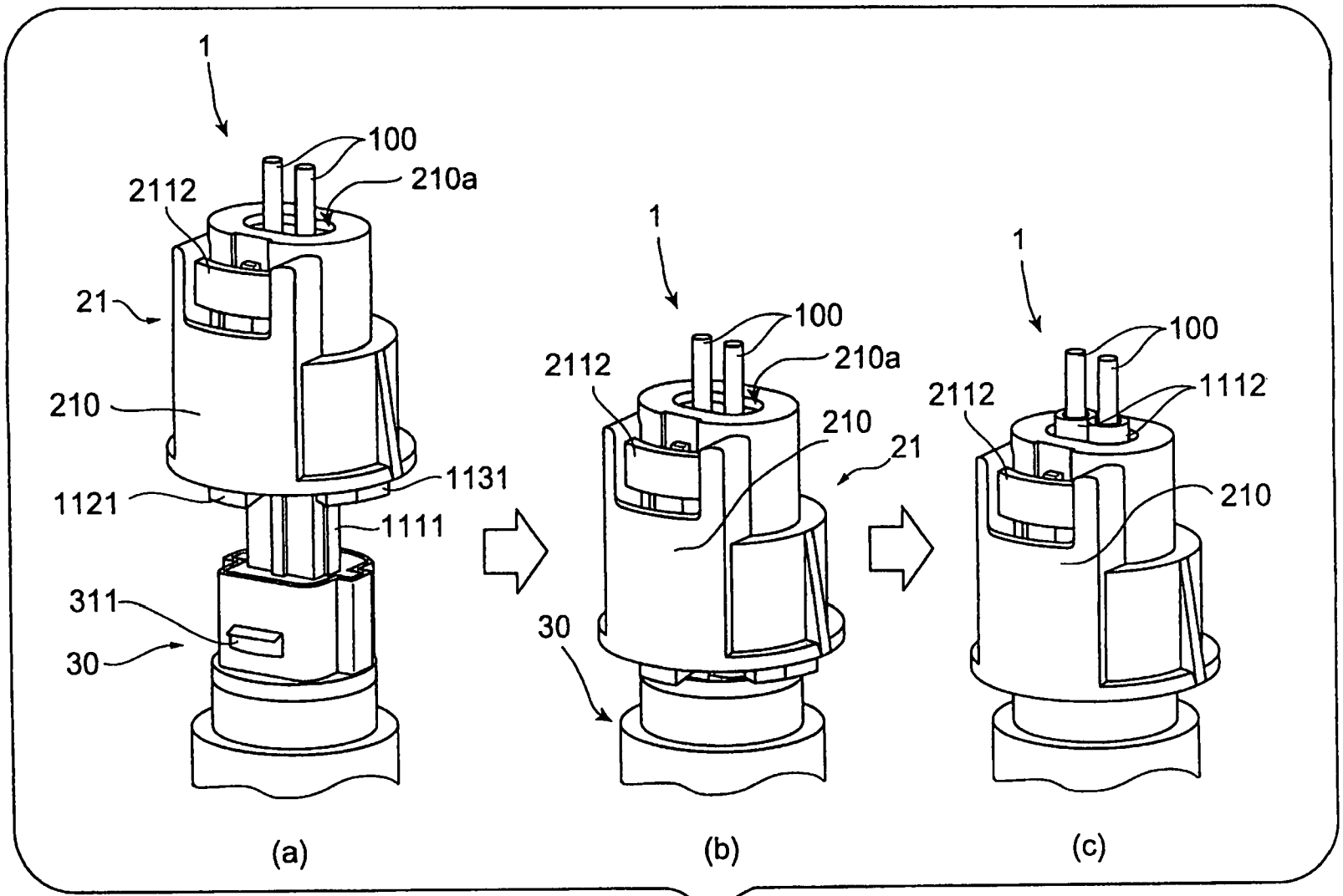
FIG. 5 shows a progression of engagement of the electrical connector of the present invention with its mating connector.

Parts (a) through (c) of FIG. 5 show a flow of engagement of the connector 1 of the present invention with its mating connector 30.

Part (a) of FIG. 5 shows that the contact engaging section 1111 of the housing 11 is about to engage the mold section 31 of the mating connector 30.

Part (b) of FIG. 5 shows that the housing 11 is engaged with the mating connector 30, when the cover 21 is in the partially engaged position and the locking section 1121 (first engaging section) of the housing 11 engages the engaging projection 311 of the mating connector 30. Part (c) of FIG. 5 shows that the locking section 1121 of the connector locking arm 112 is housed in the cover 21 and the wire holder 1112 at the rear end of the housing body 111 projects from the cover rear end opening 210*a*. In other words, Part (c) of FIG. 5 shows that the cover 21 is in the fully engaged position and the projection 2114 (second engaging section) of the housing locking arm 211 is located between the locking section 1121 and the projection 1123 of the connector locking arm 112.

Figure 6:
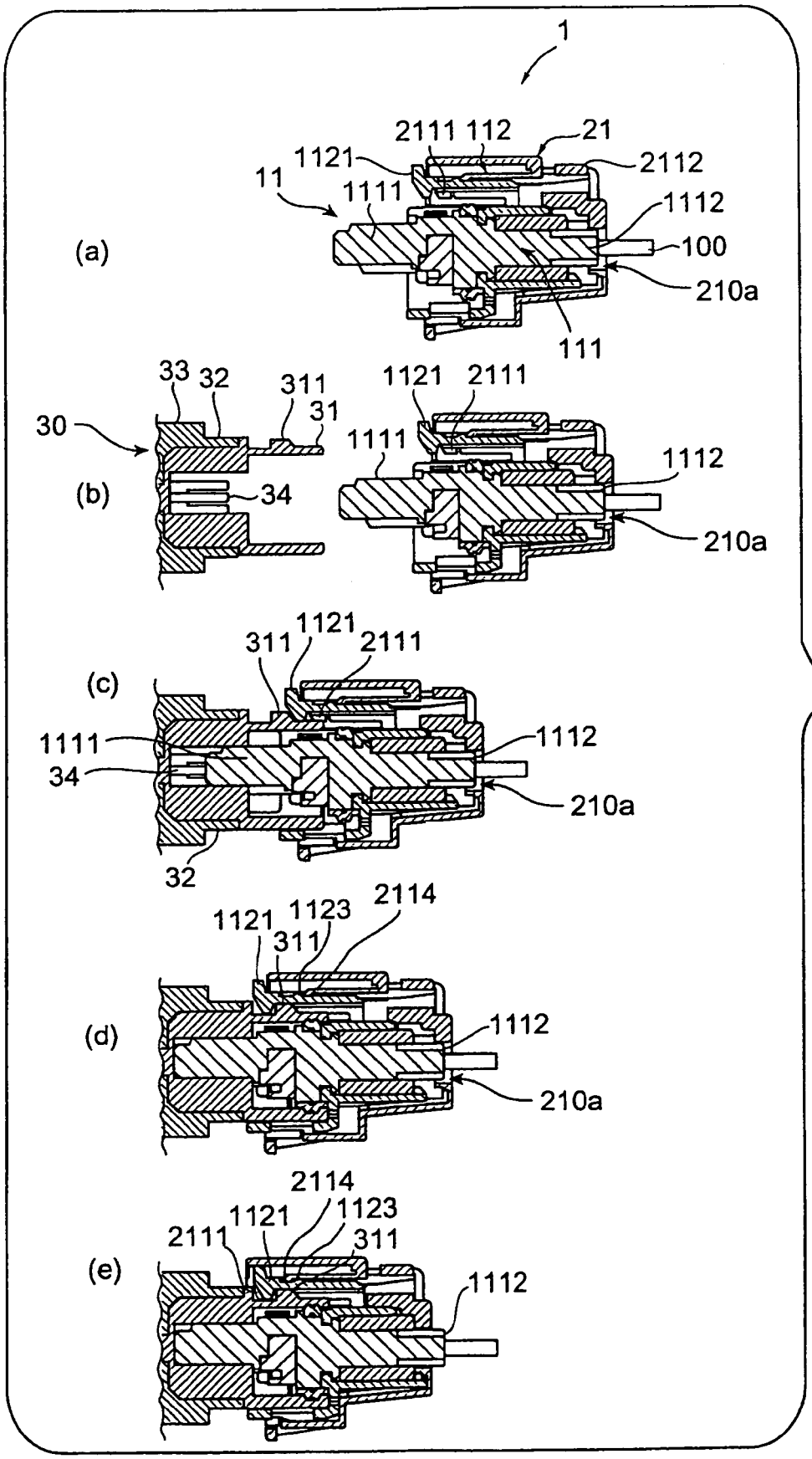
FIG. 6 is sectional views corresponding to the progression of engagement of the electrical connector of the present invention with its mating connector shown in FIG. 5.

Parts (a) through (e) of FIG. 6 are sectional views corresponding to the flow of engagement of the connector 1 with its mating connector 30 shown in FIG. 5.

Part (a) of FIG. 6 shows a sectional view of the connector 1 taken along the line C-C of Part (a) of FIG. 2 and Parts (b) through (e) of FIG. 6 show the same with the mating connector 30.

Part (a) of FIG. 6 shows only the connector 1 and Parts (b) through (e) show the connector 1 opposing the mating connector 30.

Part (c) of FIG. 6 shows the male contacts 34 of the mating connector 30 is about to be inserted into the contact receiving openings 111*a* (see FIG. 1). Part (d) of FIG. 6 shows that the locking section 1121 of the connector locking arm 112 is engaged with the engaging projection 311 of the mating connector 30 and that the cover 21 is in the partially engaged position. Further, in Part (e) of FIG. 6, the cover 21 is in the fully engaged position, after the projection 2114 of the housing locking arm 211 (see also Part (b) of FIG. 3) goes beyond the projection 1123 of the connector locking arm 112 of the housing 11 which is engaged with the mating connector 30.

As described above, the connector 1 of the present invention is configured such that the rear end of the wire holder 1112 projects from the cover rear end opening 210*a* when the cover 21 is in the fully engaged position, in which disengagement of the locking section 1121 of the connector locking arm 112 from the mating connector 30 is prevented. Thus, a worker can inspect engagement of the housing 11 with its mating connector 30 just by checking whether or not the rear end of the wire holder 1112 projects from the cover rear end opening 210*a*. This dispenses with a specific inspection member, as the housing 11 to be engaged with the mating connector 30 combined with the cover 21 also serves as an inspection member. Accordingly, the connector 1 of the present invention can achieve full engagement and easy inspection of the engagement by pushing the cover 21 into the mating connector 30 in a one-step action, while realizing minimization of the connector 1.

What is claimed is:

1. An electrical connector comprising:

a connector housing having a contact engaging section formed in the front side thereof, contacts adapted to engage mating contacts of a mating connector, and a wire holder formed in the rear side thereof which holds wires connected to the contacts of the connector housing; and a connector cover having a front end opening and a rear end opening, the cover being capable of moving between a partially engaged position and a fully engaged position, the rear end of the wire holder being housed in the cover when in the partially engaged position and the rear end of the wire holder visibly projecting from the rear end opening when in the fully engaged position;

wherein the connector housing has a first engaging section adapted to engage the mating connector fitted into the contact engaging section when the connector cover is in the partially engaged position, and the connector cover has a second engaging section which engages the first engaging section and restrains disengagement of the first engaging section from the mating connector when the connector cover is in the fully engaged position.

2. The electrical connector according to claim 1, wherein the first engaging section is shaped like an arm extending toward the front side.

3. The electrical connector according to claim 2 wherein a front end of the first engaging section projects from the front end opening of the connector cover when the connector cover is in the partially engaged position.

4. The electrical connector according to claim 3 wherein the front end of the first engaging section is housed in the connector cover when the connector cover is in the fully engaged position to maintain engagement with the mating connector.

5. The electrical connector according to claim 4 wherein the second engaging section engages the first engaging section when the connector cover is in fully engaged position, and restrains disengagement of the first engaging section from the mating connector by restraining transfer of the connector cover in the fully engaged position to the partial engaged position.

* * * * *